US005482058A

United States Patent [19]

Garçonnet

[11] Patent Number: 5,482,058

[45] Date of Patent: Jan. 9, 1996

[54] LIQUID DISPENSING COMB

[76] Inventor: Michael Garçonnet, Meulers, 76510 Saint Nicolas d'Aliermont, France

[21] Appl. No.: 194,054

[22] Filed: Feb. 9, 1994

[30] Foreign Application Priority Data

Feb. 10, 1993 [FR] France ..... 9301473

[51] Int. Cl.[6] ..... A45D 24/22; A46B 11/04

[52] U.S. Cl. ..... 132/116; 132/115; 132/152; 132/151; 401/291

[58] Field of Search ..... 132/112, 113, 132/114, 115, 116, 151, 152; 215/330, 209; 401/291, 190

[56] References Cited

U.S. PATENT DOCUMENTS

| | | | |
|---|---|---|---|
| 792,887 | 6/1905 | Erstling | 132/151 |
| 1,014,037 | 1/1912 | Benson | 132/151 |
| 1,449,096 | 3/1923 | Grieten | 132/114 |
| 1,621,269 | 3/1927 | Pickford | 132/112 |
| 1,829,021 | 10/1931 | Sinclair | 132/113 |
| 2,222,176 | 11/1940 | Hickey | 132/116 |
| 2,413,809 | 1/1947 | Arvintz | 132/151 |
| 2,446,398 | 8/1948 | Wilson | 132/116 |
| 2,617,431 | 11/1952 | Gaspari | 132/112 |
| 2,956,570 | 10/1960 | Stanford . | |
| 3,101,086 | 8/1963 | Di Vito . | |
| 3,101,856 | 8/1963 | Whiteman | 215/209 |
| 3,368,569 | 2/1968 | Lawrence . | |
| 3,456,658 | 7/1969 | Long, Jr. | 132/116 |
| 3,520,311 | 7/1970 | Iesersek et al. | 132/116 |
| 4,605,026 | 8/1986 | Nolin . | |
| 5,024,243 | 6/1991 | Synder | 132/116 |

FOREIGN PATENT DOCUMENTS

| | | | |
|---|---|---|---|
| 0043519 | 1/1982 | European Pat. Off. . | |
| 2422359 | 11/1979 | France . | |
| 800988 | 11/1950 | Germany | 132/114 |
| 37232 | 5/1959 | Luxembourg . | |
| 1456216 | 11/1976 | United Kingdom | 215/209 |

*Primary Examiner*—John G. Weiss
*Attorney, Agent, or Firm*—Browdy and Neimark

[57] ABSTRACT

The liquid dispensing comb comprises a flask containing a liquid and having a neck provided with a thread for receiving a tapped nipple of the comb. The comb has a back with at least one series of parallel teeth each having a lower part. The back has a central duct longitudinally arranged therein, in communication with the tappered nipple, and leading to capillary channels opening either between the teeth of the comb or at a lower part of the teeth of the comb. The central duct is of a circular shape with a cross-section varying from the tapped nipple to an opposite end part of the comb.

6 Claims, 3 Drawing Sheets

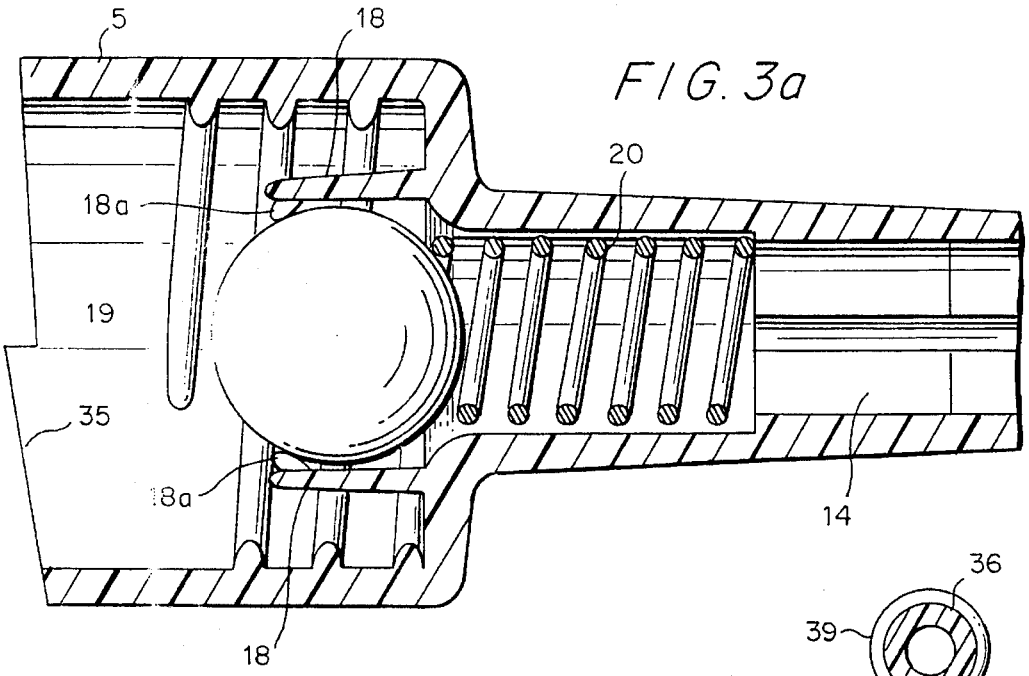
FIG. 3a
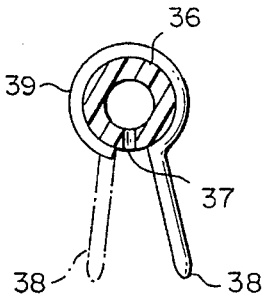
FIG. 8
FIG. 6
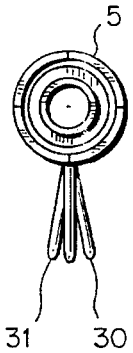
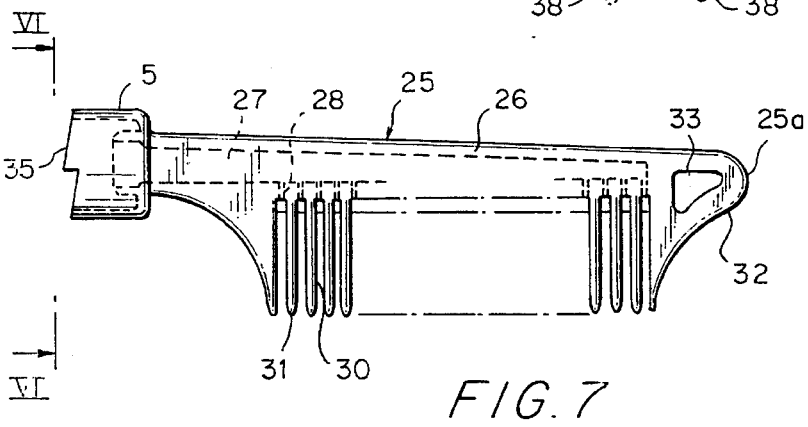
FIG. 7
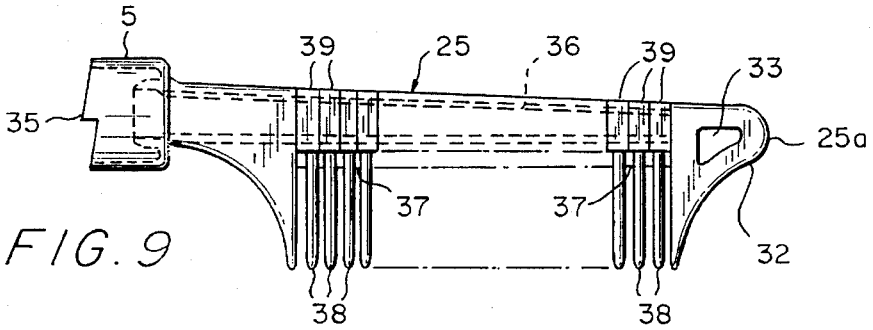
FIG. 9

LIQUID DISPENSING COMB

FIELD OF THE INVENTION

The present invention relates to a comb device enabling a dosed distribution of a liquid for capillary care, and in particular a liquid designed to hair dyeing.

BACKGROUND OF INVENTION

Up to now, when someone wants a hair dye, he or she has to take the dye from a flask and to spread it on his or her hair, either by means of a pad or by means of a brush. This has the effect, despite great practice, to either, use too much product or, to have thereafter to mop up the excess of product. This is unpleasant to do and, moreover, will dye the scalp which is not aesthetic.

Combs are also known comprising a hollow back enabling a distribution of a liquid from a handle forming a tank. However, the inner arrangement of these combs makes it difficult in time to use the comb since the product, when dried, clogs the distribution channels (see U.S. Pat. No. 3,520,311). There also exists other much more complicated systems which have not been proved satisfactory since their use has been jeopardized by a fast clogging of the distribution channels because of the design of these combs (see FR-A-2,422,359).

PURPOSE AND SUMMARY OF THE INVENTION

The present invention copes with the above difficulties by providing a comb on which can be directly mounted a flask containing the liquid for capillary care i.e. dye. This comb has a back with a plurality of teeth each having a lower part and a flask having a neck provided with a thread. The neck of the comb receives a suitably tapped nipple communicating through a central duct made in the back of the comb and leading to capillary channels that open either between the teeth of the comb or at the lower part of the teeth of the comb. The liquid is thereby suitably distributed in sufficient doses. Since the flask is slightly deformable, the user can exert a pressure on its flanks and transmit, under a light pressure, the liquid for capillary care. It should moreover be noted that the central duct for supplying the liquid in the back of the comb has a diameter increasing between the neck of the flask and the opposed end part of the comb.

Various other features of the invention will moreover be revealed from the following detailed disclosure.

BRIEF DESCRIPTION OF THE DRAWINGS

Embodiments of the invention are shown, as non limitative examples, in the accompanying drawings, wherein:

FIG. 3*a* shows, at a greater scale, a detail of the comb;

FIG. 6 is a rear elevation view of a third embodiment of the comb taken substantially along line VI—VI of FIG. 7;

FIG. 7 is a side elevation view of the comb of FIG. 6;

FIG. 7*a* is a view similar to FIG. 7 but showing a variant of the inner duct arranged in the back of the comb.

FIG. 8 is a diagrammatic cross-section of an other embodiment for a comb with teeth which are adjustable in inclination.

FIG. 9 is a side elevation view of the comb of FIG. 8.

DESCRIPTION OF THE PREFERRED EMBODIMENT

Figure 1:
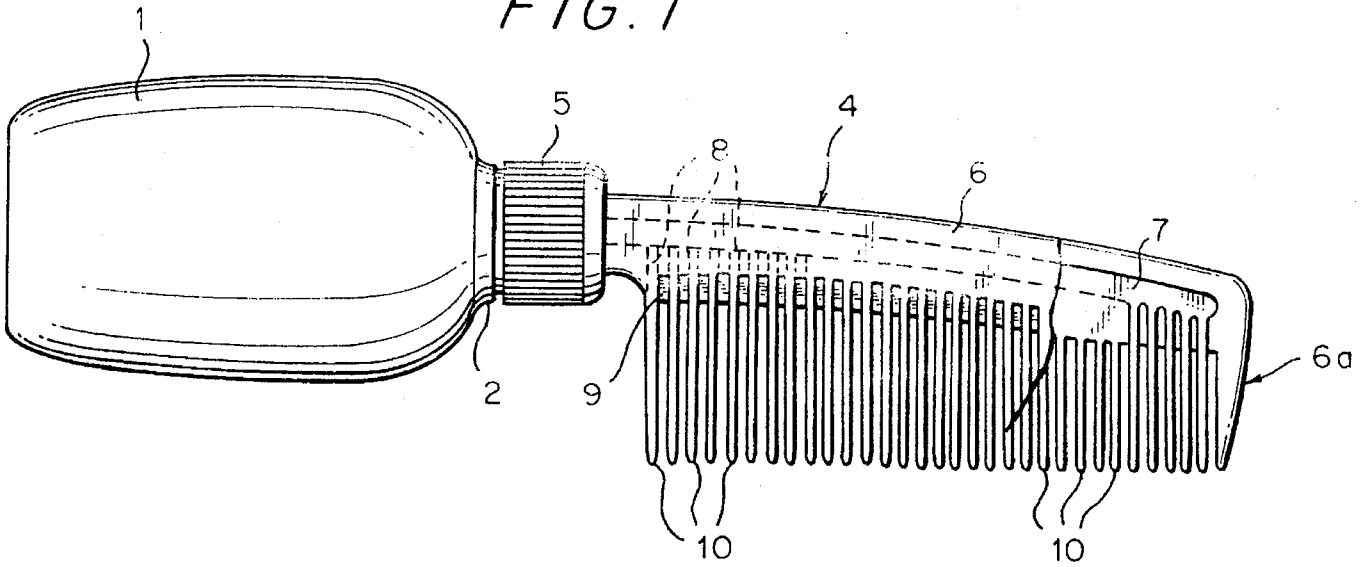
FIG. 1 is a partially cut away side elevation view of a first embodiment of the comb enabling the dosed distribution of a liquid.

In FIG. 1, there is shown a flask 1 typically made of a slightly deformable synthetic plastic material having a neck 2 which is provided on its outer surface with a thread. The thread permits a cap to tightly close the flask 1 before its sale. When the user wants to mount the flask 1 on a comb 4 to form the comb device of the invention, the user unfastens the cap and, in lieu of the same, screws on the tapped nipple 5 at the end of the back 6 of the comb 4. This back 6 is internally arranged with a duct 7 having a cross-section which is circular but increases towards the end part 6*a* of the comb 4.

Small capillary channels 8 connect the duct 7 to spaces 9 provided between the teeth 10, so that the liquid can freely flow between the teeth 10 of the comb 4.

The user can, while combing in an usual manner, distribute on his or her hair and a very thin coat of liquid in the flask 1, because of the very small cross-section of the capillary channels 8. The liquid can be either a dye or an other care product.

In the case of a dye, the quantity of product which is to be distributed is just the quantity which is necessary for the desired purpose. If some areas which are not sufficiently dyed after the first pass, it suffices to pass the comb again to obtain the desired color.

In the case when it is necessary to use a greater dose of product, the user can, by exerting a greater pressure on the flanks of the flask 1, increase the pressure of the liquid, thereby enabling it to flow in a greater quantity.

Figure 2:
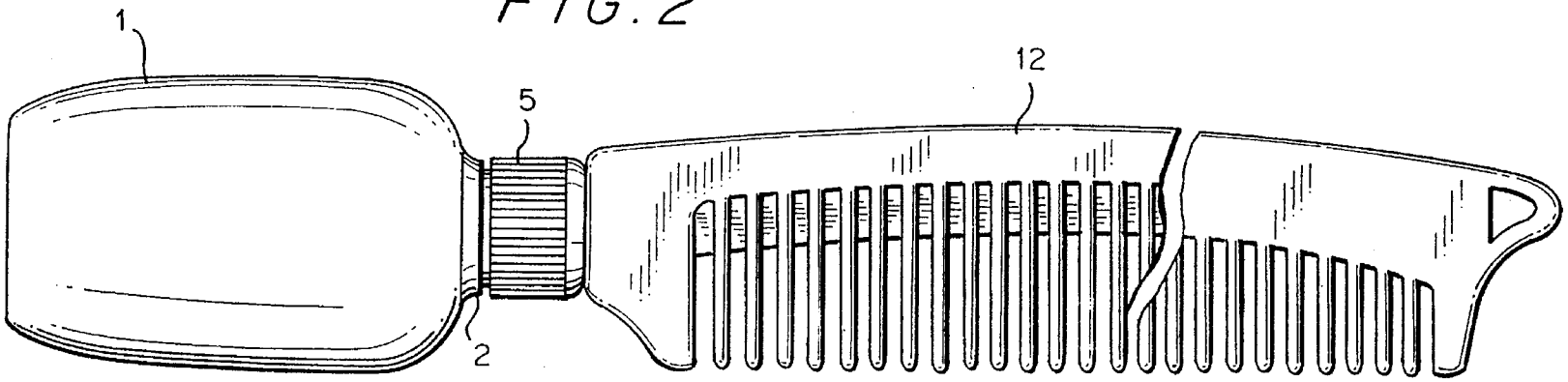
FIG. 2 is a side elevation view of a second embodiment of the invention.

In FIG. 2, as in the case of FIG. 1, the flask 1 comprises a neck 2 with an outer part which is to receive a nipple 5 of a comb 12.

The comb 12 (see FIG. 3) has a hollow back 13 having a duct 14 with a cross-section which decreases between the nipple 5 and the end 13*a* of the comb 12.

The teeth 15 of the comb 12 are hollow at 15*a*. This permits a passage of the liquid from the flask 1 through the nipple 5 and then through the duct 14 to the lower end 15*a* of each tooth 15 of the comb.

As shown in FIG. 3*a*, the front end of the duct 14 is provided with lugs 18, one part of which at least is curved at 18*a* for maintaining a small ball 19. The ball 19 is generally a hard plastic material, which is pushed back toward the inside of the nipple 5 by a spring 20, formed generally from a stainless material, positioned in the channel 14. The adjusting unit formed by the small ball 19 and spring 20 will ensures a regulated flow of the liquid contained in the flask 1 according to the pressure exerted on the flanks of the flask.

The same embodiment may be made for the comb device shown in FIG. 1.

Figure 4:
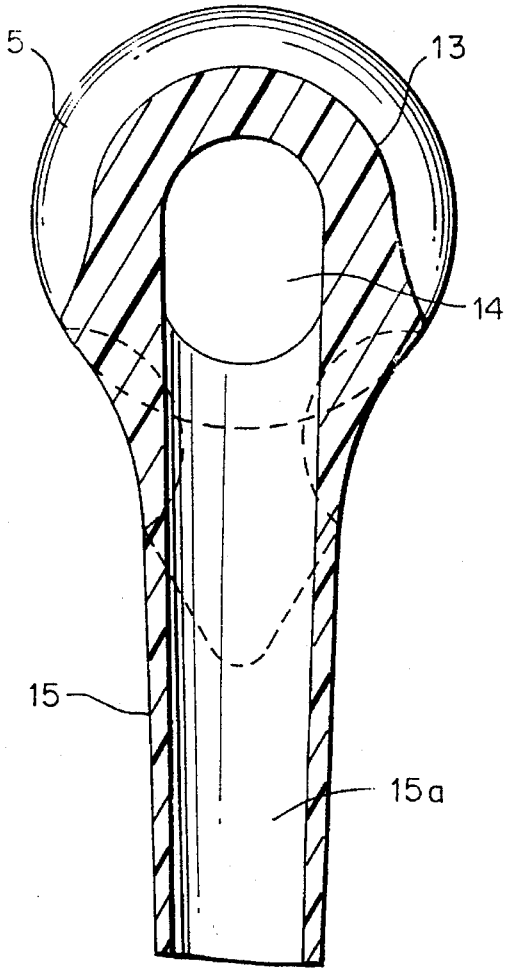
FIG. 4 is a cross-section taken along line IV—IV of FIG. 3.
Figure 5:
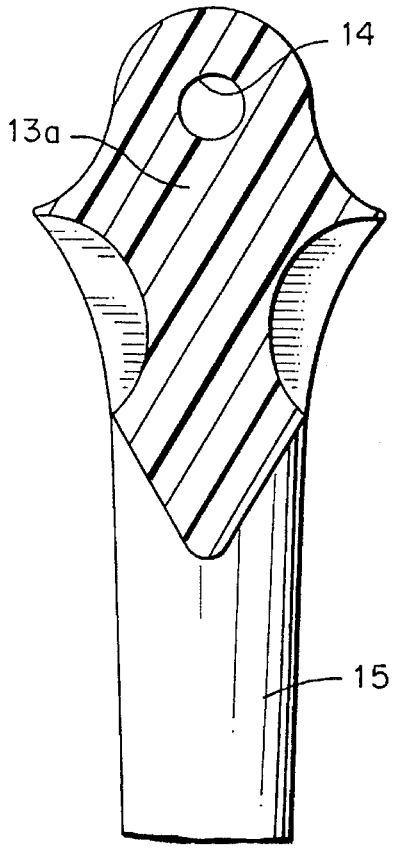
FIG. 5 is a cross-section taken along line V—V of FIG. 3.

FIGS. 4 and 5 show a cross-section at a larger scale of the embodiment of each tooth 15. The corresponding comb unit enables an easy distribution of the liquid for capillary care and the quantity of such liquid can be increased by pressing on the flank of the flask 1.

As shown in FIGS. 6 and 7, the tapped nipple 5 is used on a flask that is not shown but is of the type of flask 1 of the other figures, to fix a comb shown at 25 and having a back 26 which has a duct 27 from the nipple 5 to the front end of the comb 25. The duct 27 has an increasing or a decreasing cross-section according to the product to be placed on the hair.

In this respect, FIG. 7 shows that the duct 27 has a cross-section increasing from the nipple 5 to the front end 25*a* of the comb, while FIG. 7*a* shows a duct 27*a* with a cross-section increasing from the nipple 5 to the front end 25*a*.

Channels 28 opening at the lower part of the back of the comb 25 are arranged just above two series of teeth 30, 31 which are angularly shifted as shown in FIG. 6. The angular shifting of the two series of teeth 30, 31, which is variable, enables to easy combing of hair.

Moreover, the outer end 25*a* of the comb 25 comprises a rounded extension 32 pierced with a hole 33 enabling, on the one hand, a separation of wicks of hair, and also a suspension of the comb when not in use.

In the present embodiment and as already mentioned, the distribution of the liquid is made easily since it suffices to increase the pressure on the flanks of the flask for increasing the flow of the product between the two series of teeth 30, 31 of the comb 25.

Figure 3:
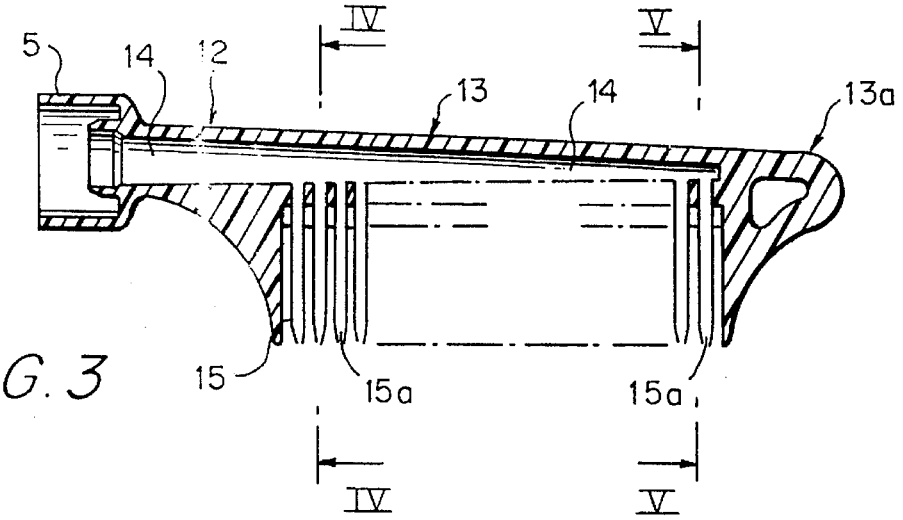
FIG. 3 is a diagrammatic longitudinal cross-section of a part of the comb shown in FIG. 2.

In some cases, the comb 25 of FIGS. 6 and 7 can be provided with the small ball and spring adjusting unit shown in FIG. 3 for ensuring a judicious repartition of the liquid contained in the flask.

In FIGS. 3*a* and 7, indentations in the form of saw tooth grooves 35 are provided on the circular outer surface of the tapped nipple 5. When the comb is screwed on the flask 1, these indentations 35 engage the neck 2 of the flask 1 and lock the comb on the flask 1.

When the flask is empty, the whole comb device can be thrown away.

In FIG. 8 and 9, the comb, a diagrammatic cross-section of which is shown, is formed by a hollow elongated part 36 with a circular cross-section. Part 36 is provided, in its lower part, with distribution channels 37. A plurality of teeth 38 form the comb. Each tooth 38 is integrally formed with a ring 39 surrounding the hollow elongated part 36.

Part 36 is formed with a rough surface, so that each ring 39 is sufficiently engaged on part 36 to form a comb with teeth 38. The liquid is distributed by the distribution channels 37 (see FIG. 7) between the rings 39 carrying the teeth 38.

In general, the above mentioned combs are manufactured by moulding of a synthetic plastic material but they could be made of other suitable material resisting to the product used for the capillary treatment.

It should however be noted that the material which is used for the comb must be a resistant material in order to be possibly cleaned by washing the comb when, after a lapse of time, there is an overload of dry products.

I claim:

1. A comb device enabling a dosed distribution of a liquid for capillary care, comprising:

a comb having a tapped nipple, a flask containing said liquid and having a neck provided with a thread receiving said tapped nipple of said comb, said comb having a back with at least one series of parallel teeth each having a lower part with said parallel teeth defining intervals therebetween, said back having a central duct longitudinally arranged therein and in communication with said tapped nipple, said central duct leading to capillary channels opening in one portion of the comb taken among said intervals between said teeth and said lower part of said teeth of said comb, and wherein said central duct is of a circular shape with a cross-section increasing from said tapped nipple to an opposite end part of said comb.

2. The comb device as set forth in claim 1, wherein the tapped nipple is insidely provided with a small ball and spring adjusting device for automatically adjusting a quantity of said liquid supplied to said teeth of said comb according to a pressure exerted on flanks of said flask.

3. The comb device as set forth in claim 1, wherein said back of said comb is provided with a first and a second series of parallel teeth, with said first series being angularly shifted with respect to said second series.

4. The comb device as set forth in claim 1, wherein said tapped nipple is provided with indentations in the form of saw tooth grooves entering said neck of said flask.

5. A comb device enabling a dosed distribution of a liquid for capillary care, comprising:

a comb having a tapped nipple, a flask containing said liquid and having a neck provided with a thread receiving said tapped nipple of said comb, said comb having a back with at least one series of parallel each having a lower part with said parallel teeth defining intervals therebetween, said back having a central duct longitudinally arranged therein and in communication with said tapped nipple, said central duct leading to capillary channels opening in one portion of the comb taken among said intervals between said teeth and said lower part of said teeth of said comb, and wherein said central duct is of a circular shape with a cross-section varying from said tapped nipple to an opposite end part of said comb, and wherein said comb comprises a hollow elongated part arranged with equidistant channels for a distribution of said liquid, said hollow elongated part carrying spaced apart rings each supporting a tooth of said at least one series of parallel teeth, in order to permit a desired spacing of said teeth.

6. The comb device as set forth in claim 5, wherein said central duct is of a circular shape with a cross-section decreasing from said tapped nipple to an opposite end part of said comb.

* * * * *

UNITED STATES PATENT AND TRADEMARK OFFICE

CERTIFICATE OF CORRECTION

PATENT NO. : 5,482,058

DATED : January 9, 1996

INVENTOR(S) : Michel Garconnet

It is certified that error appears in the above-indentified patent and that said Letters Patent is hereby corrected as shown below:

Title page, Item [76] (Inventor), change "Michael" to --Michel--.

Signed and Sealed this

Twenty-eighth Day of May, 1996

Bruce Lehman

*Attest:*

BRUCE LEHMAN

*Attesting Officer*

*Commissioner of Patents and Trademarks*